US007191852B2

(12) United States Patent
Clayton

(10) Patent No.: US 7,191,852 B2
(45) Date of Patent: Mar. 20, 2007

(54) ENERGY ACCELERATOR

(75) Inventor: Robert Clayton, Deer Park, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 120 days.

(21) Appl. No.: 10/728,996

(22) Filed: Dec. 5, 2003

(65) Prior Publication Data

US 2005/0121231 A1 Jun. 9, 2005

(51) Int. Cl.
*E21B 7/24* (2006.01)

(52) U.S. Cl. ..... 175/55; 175/56

(58) Field of Classification Search ..... 175/55, 175/56, 296, 320, 38

See application file for complete search history.

(56) References Cited

U.S. PATENT DOCUMENTS 2,893,692 A * 7/1959 Marx ..... 175/56
3,840,080 A * 10/1974 Berryman ..... 175/107
4,049,066 A * 9/1977 Richey ..... 175/323
4,266,619 A * 5/1981 Bodine ..... 175/55
4,271,915 A * 6/1981 Bodine ..... 175/56
4,408,670 A * 10/1983 Schoeffler ..... 175/298
4,518,888 A * 5/1985 Zabcik ..... 310/334
4,576,229 A * 3/1986 Brown ..... 175/298
4,662,459 A * 5/1987 Bodine ..... 175/56
4,667,742 A * 5/1987 Bodine ..... 166/301
4,890,682 A * 1/1990 Worrall et al. ..... 175/61
5,361,830 A * 11/1994 Wicks et al. ..... 166/51
5,798,488 A * 8/1998 Beresford et al. ..... 181/102
6,742,409 B2 * 6/2004 Blanchard ..... 74/425
2002/0121378 A1 * 9/2002 Zheng et al. ..... 166/381
2002/0166700 A1 11/2002 Gillis et al.

* cited by examiner

*Primary Examiner*—David Bagnell
*Assistant Examiner*—Daniel P Stephenson
(74) *Attorney, Agent, or Firm*—Haynes and Boone, LLP

(57) ABSTRACT

An apparatus for imparting mechanical vibration on a down-hole drilling system including a body, first and second couplers and a rotating member. The body includes ports configured to pass fluid through the body, and the first and second couplers are configured to couple the body to the down-hole drilling system. The rotating member is located at least partially in the body and is rotatable about an axis of rotation in response to flow of the fluid such that rotation of the rotating member generates mechanical vibration imparted on the down-hole drilling system.

20 Claims, 3 Drawing Sheets

ENERGY ACCELERATOR

BACKGROUND

The present invention relates generally to well bore drilling and, more specifically, to vibration assisted well bore drilling.

Wells used for the extraction of minerals from the earth have been drilled using various techniques and equipment. Drilling procedures used alone or in combination may include manually digging the well bore, hammering a well pipe into the earth from the well surface, fracturing formations with the use of subsurface percussion tools that impart repeated axial impacts to a drill bit, and rotating a drill bit with a drill string or with a subsurface motor connected to the drill string.

Drilling activity may rotate a drill bit against a subsurface formation to form the well bore. Roller cone bits or fixed cutter rotary bits may be used in rotary drilling. The bits are rotated in the well bore through the rotation of a drill string attached to the bit and/or by the rotary force imparted by a subsurface motor, often powered by the flow of drilling fluid through the drill string.

Such drilling activity may also include delivering axial impacts to the drill bit. Drilling fluid may be employed to provide the impact force. That is, the drilling fluid may be used to axially propel a hammer component relative to an anvil component connected with the drill bit. The axially moving hammer strikes the anvil component, which conveys the impact force to the bit. The impact thus directed via the drill bit into the bottom of the well bore fractures the formation at the base of the bore. An impact drilling device may shatter the formation much as a hammer and chisel shatter rock.

A problem which may be encountered in rotary drilling, particularly where a fixed bit is employed, is that the bit may catch or seize in the subsurface formation and stop turning while the attached drill string continues to turn. Consequently, torque may accumulate in the drill string, eventually causing the bit to suddenly break free. This sudden release of the drill bit and the associated unloading of the torque forces may then cause the drill bit to rotate more rapidly than the drill string, a phenomenon sometimes referred to as "slip-stick," which may cause problems with the drilling assembly, the formation of the well bore and/or the drill bit. The slip-stick phenomenon may be mitigated by reducing the weight-on-bit, but the reduction of weight-on-bit may produce undesirable effects such as reduction of the rate of penetration into the formation and/or the initiation of harmful vibrations, including bit whirl.

Accordingly, what is needed in the art is a drilling system and/or apparatus that addresses the above-discussed issues.

SUMMARY

The present disclosure provides an apparatus for imparting mechanical vibration on a down-hole drilling system including a body, first and second couplers and a rotating member. The body includes ports configured to pass fluid through the body, and the first and second couplers are configured to couple the body to the down-hole drilling system. The rotating member is located at least partially in the body and is rotatable about an axis of rotation in response to flow of the fluid such that rotation of the rotating member generates mechanical vibration imparted on the down-hole drilling system.

The present disclosure also introduces an energy accelerator for imparting energy to a down-hole drilling member. In one embodiment, the energy accelerator includes a body configured to receive external energy and a converter located at least partially within the body and configured to convert the external energy into vibration energy. The energy accelerator also includes a vibrating member configured to impart the vibration energy to the down-hole drilling member.

A down-hole drilling system is also provided in the present disclosure. The down-hole drilling system includes a drill string assembly, a drilling member and an energy accelerator coupled between the drill string assembly and the drilling member. The energy accelerator includes: (1) a body having ports configured to pass fluid through the body; (2) first and second couplers configured to couple the body between the drill string assembly and the drilling member; and (3) a rotating member located at least partially in the body and rotatable about an axis of rotation in response to flow of the fluid, wherein rotation of the rotating member generates mechanical vibration imparted on the drilling member.

The foregoing has outlined preferred and alternative features of several embodiments so that those skilled in the art may better understand the detailed description that follows. Additional features will be described below that further form the subject of the claims herein. Those skilled in the art should appreciate that they can readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
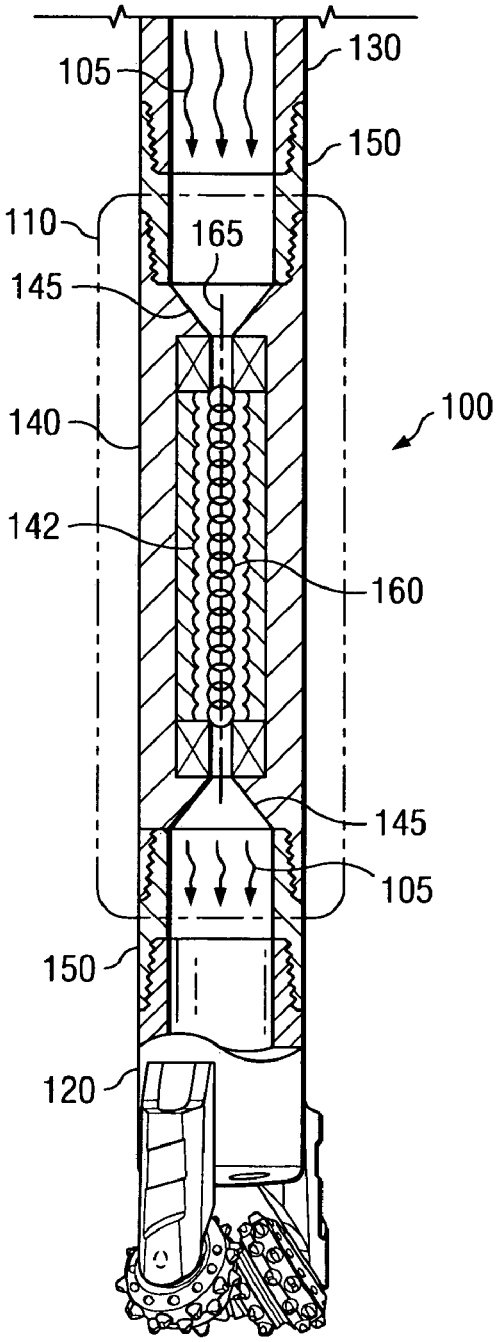
FIG. 1 illustrates a schematic view of one embodiment of a drilling system constructed according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over, on or coupled to a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a schematic view of one embodiment of a drilling system 100 constructed according to aspects of the present disclosure. The system 100 includes an energy accelerator 110 coupled between a drilling member 120 and a drill string assembly 130. The drilling member 120 and the drill string assembly 130 may be conventional. For example, the drilling member 120 may be a fixed cutter drill bit, such as a polycrystalline diamond composition bit, and the drill string assembly 130 may comprise a plurality of drill pipes through which drilling mud and/or other drilling fluids 105 may pass during drilling operations. Generally, rotation of the drill string assembly 130, or a lower portion thereof, causes the drilling member 120 to bore through rock and/or other materials at the bottom of a well-bore. The energy accelerator 110 may be rigidly coupled to the drilling member 120 and the drill string assembly 130, such that rotation of the drill string assembly 130 operates through the energy accelerator 110 which, in turn, cause the drilling member 120 to rotate.

The energy accelerator 110 includes a body 140 having ports 145 configured to pass the drilling fluid 105 through the body 140. In one embodiment, the ports 145 are openings formed in the body, possibly having a shape configured to funnel or otherwise direct the drilling fluid 105 to a desired region or component of the energy accelerator 110. The ports 145 may also include valves that may be directly or remotely manipulated by hydraulic-, mechanical-, electrical- and/or hand-operation. The ports 145 are also configured to pass the drilling fluid 105 out of the energy accelerator 110, such that the drilling fluid 105 may be employed for drilling operations below the energy accelerator 110.

The energy accelerator 110 also includes couplers 150 configured to couple the body 140 to the down-hole drilling system 100. For example, in the illustrated embodiment, the couplers 150 couple the energy accelerator 110 between the drill string assembly 130 and the drilling member 120. The couplers 150 may be or comprise male and/or female threaded connectors, such that the couplers 150 may detachably couple the energy accelerator 110 to the drilling member 120 and the drill string assembly 130. The couplers 150 may also comprise pinned and/or box connectors, as known in the art. The couplers 150 may be formed integral to the body 140 or may be discrete components welded or otherwise fastened to the body 140.

The energy accelerator 110 also includes a rotating member 160 located at least partially in the body 140 and rotatable about an axis of rotation 165 in response to flow of the drilling fluid 105. For example, the ports 145 may funnel or otherwise direct flow of the drilling fluid 105, or a tapped portion of the drilling fluid 105, to and/or across the rotating member 160, and the rotating member 160 may have a spiraled-, helix- or finned shape configured to cause the rotating member 160 to rotate as the drill fluid 105 flows past.

In one embodiment, the rotating member 160 cooperates with at least a portion of the body 140 in a rotor/stator configuration. For example, the rotating member 160 and the body 140 may cooperate to form a positive displacement motor (PDM). That is, the rotating member 160 may have an outer surface resembling a first spiral-helix, and at least a portion of the body 140 may have an inner surface or cavity 142 resembling a second spiral-helix configured to receive or engage the first spiral-helix surface of the rotating member 160.

Conventionally, a PDM consists of a stator and a rotor. A conventional stator has an inner cavity in the shape of a spiral-helix and a conventional rotor is a solid member having a spiral shape configured to engage the inner cavity of the stator and form a spiral-shaped seal line traversing the length of the PDM and defining a sealing cavity. When the rotor is rotated relative to the stator in response to an external motor, the sealing cavity traverses the length of the PDM, continuously appearing and disappearing to complete its energy transformation, thereby displacing fluid from the stator. Thus, the PDM generally operates on the basis of an Archimedes screw or other screw motor.

However, embodiments of the energy accelerator 110 in which the rotating member 160 has a spiral-helix outer shape and body 140 has a spiral-helix inner cavity 142 operate in reverse to the operation of a conventional PDM. That is, rather than driving the rotation of the rotating member 160 with an external motor to displace fluid within the body 140, the flow of the drilling fluid 105 causes the rotating member 160 to rotate within the body 140. Moreover, the drilling fluid 105 may have non-uniform density or may be pumped through the drill string assembly 130 into the energy accelerator 110 under fluctuating pressure. Consequently, the rotating member 160 will convert the energy delivered by the flow of the drilling fluid 105 into vibration energy.

That is, as the rotating member 160 rotates within the body 140, the rotating member 160 will vibrate at least partially in response to the variations in the density and pumping pressure of the drilling fluid 105. This vibration may be in an axial direction parallel with the axis of rotation 165. However, the variation may also or alternatively be in a direction orthogonal to the axis of rotation 165. Moreover, in one embodiment, the rotating member 160 may have a center of gravity that is offset from the axis of rotation 165. For example, a portion of the rotating member 160 may comprise a material having a density that varies from the density of the remainder of the rotating member 160, or the rotating member 160 may be offset from and/or pitched in relation to a centerline of the housing 140.

Thus, the rotation of the rotating member 160 in response to the flow of the drilling fluid 105 will cause the rotating member 160 to vibrate in one or more directions. Because the rotating member 160 contacts the inner surface 142 the body 140, the rotating member 160 will impart this vibration to the body 140, thereby causing the body 140 to also vibrate. The spiral-helix shape of the cavity 142 of the body 140 and the rotating member 160 also allow multi-directional vibration to be imparted on the body 140 by the rotating member 160.

As described above, the body 140 is coupled to the drilling member 120. Consequently, the vibration of the body 140 may also be imparted to the drilling member 120. Similarly, the vibration of the body 140 may be imparted to the drill string assembly 130. In one embodiment, the vibration of the body 140 may be imparted to the drilling member 120 and the drill string assembly 130.

Thus, in general, the body 140 is configured to received external energy in the form of drilling fluid 105 flowing thereto. The rotating member 160 and/or the body 140 converts the external energy into vibration energy. The rotating member 160 is configured to impart the vibration energy to the body 140, and the body 140 is configured to impart the vibration energy to the drilling member 120 and/or the drill string assembly 130, such that the rotating member 160 and the body 140 are both vibrating members of the energy accelerator 110. The vibration of the rotating member 160 and/or the body 140 may have a frequency ranging between about 0.5 Hz and about 50 Hz, possibly at an amplitude ranging between about 1 G and about 15 G.

The energy accelerator 110 described above is also readily adapted to be powered by external energy other than the flow of the drilling fluid 105. For example, the external energy may comprise hydraulic energy from fluids other than the drilling fluid 105 or electrical energy generated near or remote from the energy accelerator 110, including by surface level energy sources. In such embodiments, the external energy may be employed to rotate the rotating member 160 within the body 140, possibly with a rotary or step motor that may interface with the rotating member 160 via a geared mechanism, even in the absence of the drilling fluid 105.

The vibration of the drilling member 120 may assist in the release of the drilling member 120 when the drilling member 120 becomes seized in the rock or other materials at the bottom of a well-bore. Accordingly, delays in drilling progress may be minimized. The drilling rate may also be increased by the vibration of the drilling member 120, because the vibration may assist in the cutting of the well-bore material in addition to preventing the drilling member 120 from seizing. Moreover, because the vibration of the drilling member 120 may increase the drilling rate, the weight-on-bit and bit speed required to achieve a desired drilling rate may be reduced. That is, energy employed for operating the drilling member 120, including the weight-on-bit and bit speed, may be accelerated by the vibration energy generated by the energy accelerator 110. In addition, the reduction in seizures of the drilling member 120, as well as the reduction in the required weight-on-bit, may increase the operational life of a conventional or future-developed motor or other power source employed to rotate the drilling member 120, and may also increase the operational life of the drilling member 120 and other components of the drilling system 100. Similarly, the maintenance requirements of the components of the drilling system 100 may also be decreased.

The energy accelerator 110 may also include one or more isolation members integral or coupled to the body 140 or elsewhere to isolate the vibration of the rotating member 160 from external components. For example, the energy accelerator 110 may include an isolation member between the body 140 or a vibrating portion thereof and the drill string assembly 130, such that the vibration is only imparted on the drilling member 120. However, as discussed above, it may be desired that the vibration of the body 140 be imparted on the drill string assembly 130. For example, such an embodiment may reduce friction forces between the drill string assembly 130 and a surrounding casing, possibly by the conversion of static friction to dynamic friction or decreasing a coefficient of static and/or dynamic friction.

Figure 2A:
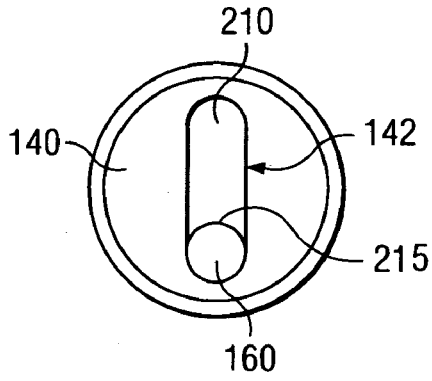
FIGS. 2A–2F illustrate sectional views of several embodiments of an energy accelerator constructed according to aspects of the present disclosure.
Figure 2B:
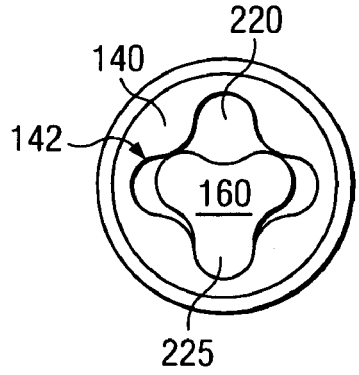
Figure 2C:
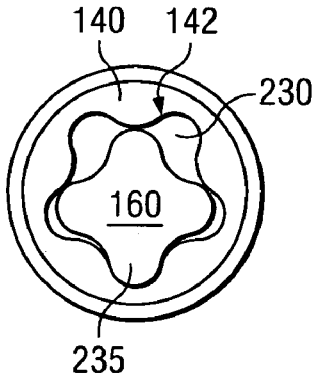
Figure 2D:
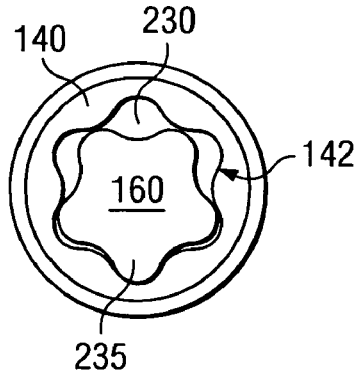
Figure 2E:
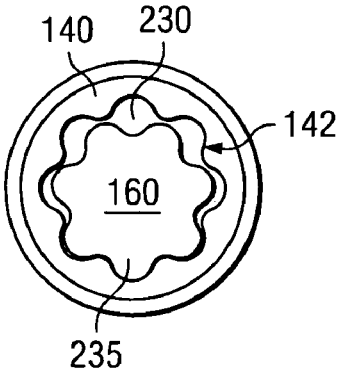
Figure 2F:
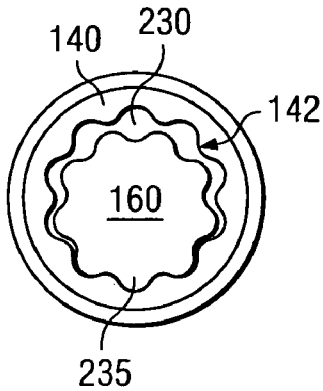

Referring to FIGS. 2A–2F, illustrated are sectional views of several embodiments of the energy accelerator 110 shown in FIG. 1 according to aspects of the present disclosure. For example, FIG. 2A illustrates that the inner surface or cavity 142 of the body 140 may have two lobes 210 and the rotating member 160 may have one lobe 215, and FIG. 2B illustrates that the inner surface 142 may have four lobes 220 and the rotating member 160 may have three lobes 225. Similarly, FIGS. 2C–2F illustrate that the inner surface 142 of the body 140 may have 5, 6, 8 or 10 lobes 230 and that the rotating member 160 may have 4, 5, 7 or 9 lobes 235, respectively. Of course, the present disclosure does not limit the number of lobes of either the rotating member 160 or the body cavity 142. In general, the number of lobes may be selected to achieve a desired vibration frequency and/or an amplitude range or median. In addition, although not illustrated as such, the rotating member 160 may be unbalanced, possibly by incorporating materials of varying density or an asymmetric geometry. For example, in FIG. 2B, one or more of the lobes 225 of the rotating member 160 may comprise a material that is different than the material of the remaining lobes 225.

Figure 3:
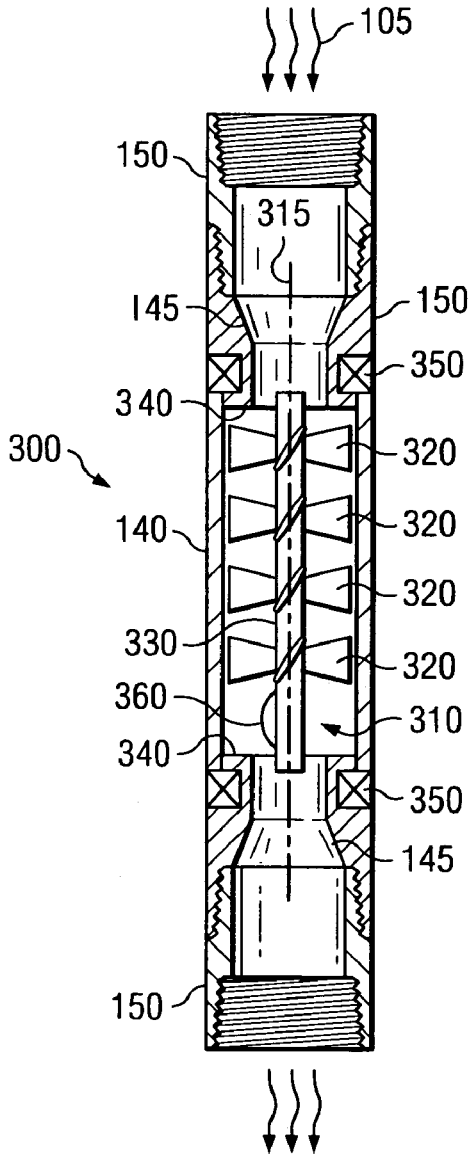
FIG. 3 illustrates a schematic view of another embodiment of an energy accelerator constructed according to aspects of the present disclosure.

Referring to FIG. 3, illustrated is a schematic view of another embodiment of an energy accelerator 300 constructed according to aspects of the present disclosure. The energy accelerator 300 may be substantially similar in composition, manufacture and function to the energy accelerator 110 shown in FIG. 1, in that the energy accelerator 300 includes a body 140 having ports 145 and couplers 150 through which drilling fluid 105 may pass. The energy accelerator 300 also includes a rotating member 310 configured to rotate about an axis of rotation 315 in response to flow of the drilling fluid 105. The rotating member 310 may comprise finned elements 320, such as or resembling a fan or turbine rotor, possibly coupled to a common shaft 330. The rotating member 310 may also be rigidly or rotatably coupled to support structure 340 which may be coupled to or rest against the housing 140.

As in the illustrated embodiment, the energy accelerator 300 may also include rotary and/or thrust bearings 350 interposing the support structure 340 or other components of the rotating member 310 and the body 140. The bearings 350 may be one manner in which vibration of the rotating member 310 in response to flow of the drilling fluid 105 may be imparted to the body 140. The energy accelerator 300 may also include an asymmetry mass 360 coupled to or formed integral with the shaft 330 or other component of the rotating member 310. Consequently, the center of gravity of the rotating member 310 may be offset from the axis of rotation 315, such that rotation of the rotating member 310 may cause multi-directional vibration. In one embodiment, the energy accelerator 300 may employ the rotating member 310 to vertically reciprocate a mass to generate additional vertical vibration.

Figure 4:
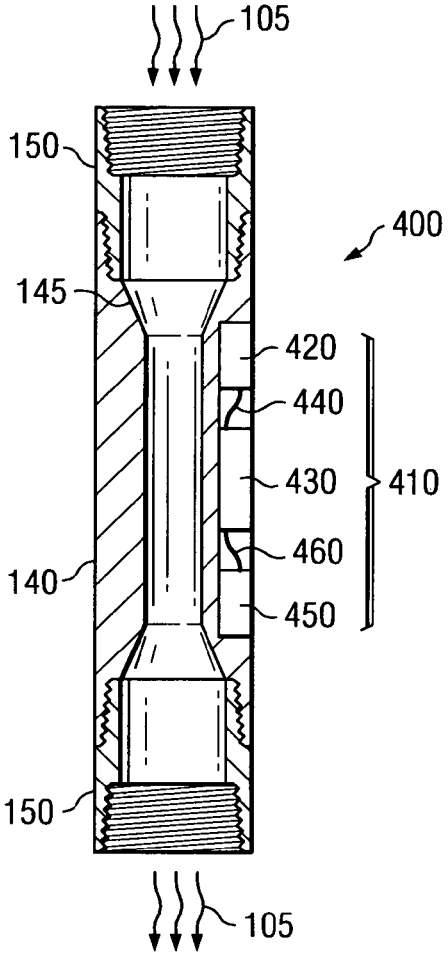
FIG. 4 illustrates a schematic view of another embodiment of an energy accelerator constructed according to aspects of the present disclosure.

Referring to FIG. 4, illustrated is a schematic view of another embodiment of an energy accelerator 400 constructed according to aspects of the present disclosure. The energy accelerator 400 may be substantially similar in composition, manufacture and function to the energy accelerator 110 shown in FIG. 1, in that the energy accelerator 400 includes a body 140 having ports 145 and couplers 150 through which drilling fluid 105 may pass. The energy accelerator 400 also includes a piezoelectric system 410. It is contemplated that piezoelectric cells may be employed to convert the mechanical stress and vibrations existent during drilling operations employing conventional drilling systems into electrical signals that are, in turn, employed to drive additional piezoelectric cells to impart vibrations on the drilling system or components thereof, as described above with reference to FIGS. 1 and 3. The concept is counterintuitive to existing piezoelectric-vibration applications, wherein vibrations are damped by piezoelectric cells that convert the vibrations into electricity which is then directed across a shunt circuit to be dissipated as heat energy. In contrast, the present disclosure contemplates collecting randomly-directed vibrations from the drilling system and imparting the collected vibrations back to the drilling system as refined, more uniform vibration energy.

For example, as shown in FIG. 4, the piezoelectric system 410 includes one or more piezoelectric sensors 420 configured to detect vibration energy in one or more directions of vibration and convert that energy into an electronic signal. The electronic signal is then communicated with a controller 430, possibly via hard wiring 440, as shown, or by electronic traces or interconnects on a circuit board. The controller 430 may then manipulate the electronic signal, such as by modifying the amplitude, frequency and/or phase of the signal. In one embodiment, the controller 430 includes a processor and memory for performing the signal modification. The modified signal is then communicated to one or more actuators 450, possibly via hard wiring 460, as shown, or by circuit board conductors. Two or more of the sensors 420, controller 430 and actuators 450 may be formed on one or more circuit boards.

The actuators 450 are configured to convert the electrical signals received from the controller 430 into vibration energy which is imparted on the drilling system through the body 140. For example, the actuators 450 may include a rotary, step or linear motor configured to be driven by electrical signals. The motor may thereby oscillate a mass or impact the body 140 to generate the desired vibration energy.

Figure 5A:
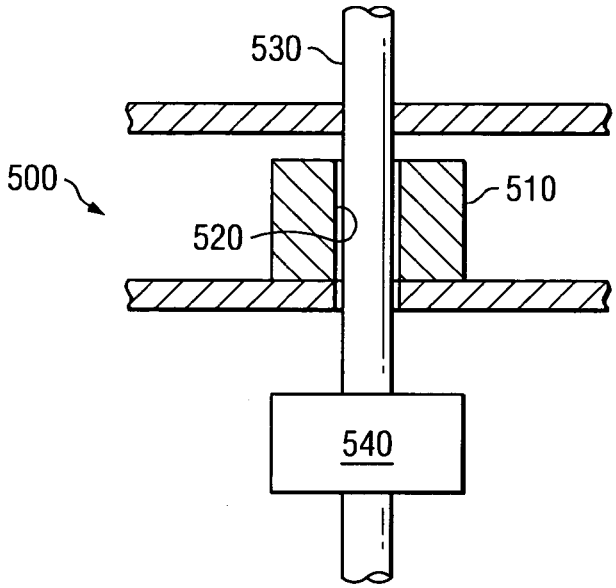
FIGS. 5A and 5B illustrate sectional views of one embodiment of an energy accelerator regulator constructed according to aspects of the present disclosure.
Figure 5B:
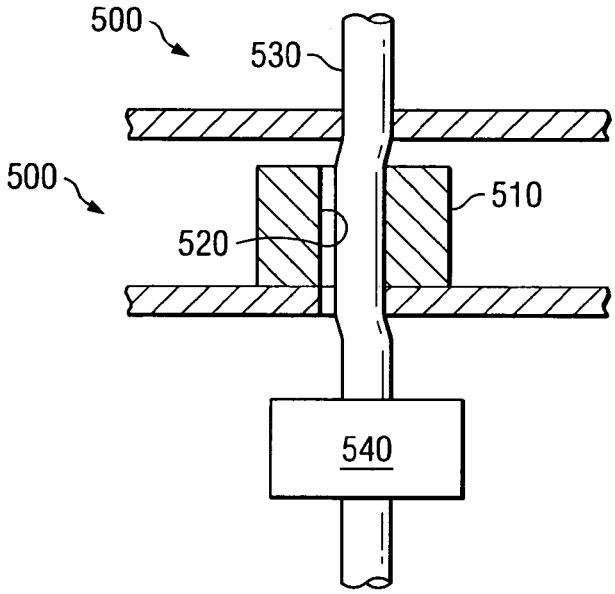

Referring to FIGS. 5A and 5B collectively, illustrated are sectional views of one embodiment of an energy accelerator regulator 500 constructed according to aspects of the present disclosure. The regulator 500 may be employed with either of the energy accelerators 110, 300 of FIGS. 1 and 2. However, for the purpose of clarity, the regulator 500 will be described below in reference to the energy accelerator 110 of FIG. 1.

The regulator 500 may be employed as a feedback mechanism to regulate the flow of external power to the rotating member 160. Accordingly, the magnitude of vibrations imparted to the drilling member 120 by the energy accelerator 110 may be regulated. As in the embodiment shown in FIG. 5A, the regulator 500 includes a ported mass 510 that is spring loaded to align its port 520 to a hydraulic fluid line 530 through which hydraulic fluid flows.

As drilling operations are performed, vibrations generated by the drilling operations may displace the mass 510 towards a biased position, as shown in FIG. 5B. Consequently, the port 520 may become misaligned to the hydraulic fluid line 530, thereby reducing the hydraulic fluid flow. As the drilling operation vibrations increase, the mass 510 may be further displaced from its neutral position shown in FIG. 5A, thereby further restricting the hydraulic fluid flow. This variation in hydraulic fluid flow through the mass 510 may be employed to control a valve 540 which may throttle the flow of the drilling fluid 105 to the rotating member 160 of the energy accelerator 110 (see FIG. 1).

Accordingly, flow of the drilling fluid 105 to the rotating member 160 may be reduced when drilling operation vibrations are intense, such that operation of the energy accelerator 110 may be slowed or ceased when additional energy acceleration may be less necessary. Consequently, the rotational velocity of the rotating member 160 may decrease, thereby reducing the intensity of vibration imparted by the energy accelerator 110 to the drilling system 100. In turn, the mass 510 may settle towards the neutral position 515, thereby allowing more hydraulic fluid flow through the fluid line 530, consequently increasing the flow of drilling fluid 105 to the rotating member 160. During drilling operations it is contemplated that a dynamic balance would be achieved. Moreover, such a feedback mechanism may be employed to regulate either axial vibration or non-axial vibration.

Although embodiments of the present disclosure have been described in detail, those skilled in the art should understand that they can make various changes, substitutions and alterations herein without departing from the spirit and scope of the present disclosure.

What is claimed is:

1. An apparatus for imparting mechanical vibration on a down-hole drilling system, comprising:

a body having ports configured to pass fluid through the body;

first and second couplers configured to couple the body to the down-hole drilling system; and a rotating member located at least partially in the body and rotatable about an axis of rotation in response to flow of the fluid, wherein rotation of the rotating member generates mechanical vibration imparted on the down-hole drilling system, wherein an interior surface of the body comprises a first lobed geometry having a first number of lobes and wherein an exterior surface of the rotating member comprises a second lobed geometry having a second number of lobes, the second number of lobes being different than the first number of lobes, wherein a center of gravity of the rotating member is offset from the axis of rotation.

2. The apparatus of claim 1 wherein the rotating member comprises an outer spiraled geometry.

3. The apparatus of claim 1 wherein the body comprises an inner spiraled geometry.

4. The energy accelerator of claim 1 wherein the vibrating member vibrates in response to the vibration energy at a frequency ranging between about 0.5 Hz and about 50 Hz.

5. The energy accelerator of claim 1 wherein the vibrating member vibrates in response to the vibration energy at an amplitude ranging between about 1 G and about 15 G.

6. An energy accelerator for imparting energy to a down-hole drilling member, comprising:

a body configured to receive external energy;

a converter located at least partially within the body and configured to convert the external energy into vibration energy; and at least one vibrating member configured to impart the vibration energy to the down-hole drilling member, wherein an interior surface of the body comprises a first lobed geometry having a first number of lobes and wherein an exterior surface of vibrating member comprises a second lobed geometry having a second number of lobes, the second number of lobes being different than the first number of lobes, wherein the vibrating member vibrates in response to the vibration energy at a frequency ranging between about 0.5 Hz and about 50 Hz.

7. The energy accelerator of claim 6 wherein the down-hole drilling member is configured to rotate about an axis of rotation and the vibrating member vibrates in response to the vibration energy in one of a first direction substantially parallel with the axis of rotation and a second direction substantially orthogonal to the axis of rotation.

8. The energy accelerator of claim 7 wherein the vibrating member vibrates in the first and second directions.

9. The energy accelerator of claim 6 wherein the vibrating member is integral to the body.

10. The energy accelerator of claim 6 wherein the vibrating member is integral to the converter.

11. The energy accelerator of claim 6 wherein the external energy comprises fluid flow energy.

12. The energy accelerator of claim 6 wherein the external energy comprises electrical energy.

13. The energy accelerator of claim 6 wherein the vibrating member vibrates in response to the vibration energy in a plurality of random directions.

14. The energy accelerator of claim 6 wherein the vibrating member vibrates in response to the vibration energy at an amplitude ranging between about 1 G and about 15 G.

15. An energy accelerator for imparting energy to a down-hole drilling member, comprising:

a body configured to receive external energy;

a converter located at least partially within the body and configured to convert the external energy into vibration energy; and at least one vibrating member configured to impart the vibration energy to the down-hole drilling member, wherein an interior surface of the body comprises a first lobed geometry having a first number of lobes and wherein an exterior surface of vibrating member comprises a second lobed geometry having a second number of lobes, the second number of lobes being different than the first number of lobes, wherein the vibrating member vibrates in response to the vibration energy in a plurality of random directions.

16. The energy accelerator of claim 15 wherein the vibrating member vibrates in response to the vibration energy at a frequency ranging between about 0.5 Hz and about 50 Hz.

17. An energy accelerator for imparting energy to a down-hole drilling member, comprising:

a body configured to receive external energy;

a converter located at least partially within the body and configured to convert the external energy into vibration energy; and at least one vibrating member configured to impart the vibration energy to the down-hole drilling member, wherein an interior surface of the body comprises a first lobed geometry having a first number of lobes and wherein an exterior surface of vibrating member comprises a second lobed geometry having a second number of lobes, the second number of lobes being different than the first number of lobes, wherein the vibrating member vibrates in response to the vibration energy at an amplitude ranging between about 1 G and about 15 G.

18. The energy accelerator of claim 17 wherein the vibrating member vibrates in response to the vibration energy at a frequency ranging between about 0.5 Hz and about 50 Hz.

19. An energy accelerator for imparting energy to a down-hole drilling member, comprising:

a body configured to receive external energy;

a converter located at least partially within the body and configured to convert the external energy into vibration energy; and at least one vibrating member configured to impart the vibration energy to the down-hole drilling member, wherein:

the vibration energy is energy accelerating vibration energy;

the external energy comprises drilling vibration energy generated at least partially by the drilling member; and the converter includes a piezoelectric device configured to convert the drilling vibration energy into the energy accelerating vibration energy.

20. An energy accelerator for imparting energy to a down-hole drilling member, comprising:

a body configured to receive external energy;

a converter located at least partially within the body and configured to convert the external energy into vibration energy;

at least one vibrating member configured to impart the vibration energy to the down-hole drilling member; and a regulator configured to limit the vibration energy imparted to the down-hole drill member by regulating a flow of the external energy to the body.

* * * * *